United States Patent [19]

Ruemer, Jr. et al.

[11] 4,363,179

[45] Dec. 14, 1982

[54] PROMOTIONAL CAN END

[75] Inventors: John Ruemer, Jr., Baltimore, Md.; Vinson S. Potts, Cherry Hill, N.J.

[73] Assignee: Crown Cork & Seal Company, Inc., Philadelphia, Pa.

[21] Appl. No.: 286,866

[22] Filed: Jul. 27, 1981

[51] Int. Cl.[3] ..... G09F 3/18

[52] U.S. Cl. ..... 40/307

[58] Field of Search ..... 40/306, 307, 2; 220/269

[56] References Cited

U.S. PATENT DOCUMENTS

| | | | |
|---|---|---|---|
| 3,822,496 | 7/1974 | Minder | 40/307 |
| 3,958,354 | 5/1976 | Hough | 40/307 |
| 4,030,631 | 6/1977 | Brown | 220/269 |
| 4,083,471 | 4/1978 | Frank | 220/258 |
| 4,096,967 | 6/1958 | Kaminski | 220/269 |
| 4,184,607 | 1/1980 | Potts | 220/269 |
| 4,203,240 | 5/1980 | Goodwin | 40/2 R |

*Primary Examiner*—Gene Mancene
*Assistant Examiner*—Wenceslao J. Contreras
*Attorney, Agent, or Firm*—Woodcock, Washburn, Kurtz, Mackiewicz & Norris

[57] ABSTRACT

An improved can end of the type openable without tools by a consumer moving a tab to rupture a can end along a score line, which features promotional material concealed beneath the tab until the tab is pivoted so as to open the can, is disclosed.

6 Claims, 3 Drawing Figures

PROMOTIONAL CAN END

FIELD OF THE INVENTION

This invention relates to the field of cans for the containment of beverages and the like. More particularly, the invention relates to can ends and methods of their manufacture which are provided with promotional material of the game type in which a player of the game must purchase the product in order to play the game.

BACKGROUND OF THE INVENTION

In recent years it has become increasingly popular to provide promotional material of the game type in which players are obliged to purchase quantities of a particular manufacturer's goods in order to continue to play the game. Numerous expedients have been developed for such purpose. One of the more popular in the art of manufacture of cans for the containment of beverages and the like relates to cans of the type in which a ring is attached to a detachable portion of an end of the can. A consumer of the beverage within the can pulls on the ring with a finger and removes a section of the end. Promotional materials such as a portion of a puzzle or one element of a "bingo" type game or the like is concealed by being printed on the under side of the removable portion of the can end and is exposed only by removal thereof. Accordingly, the consumer must open the can in order to play the game.

This can end structure has the very significant defect that once the consumer opens the can he is left with a pull tab and ring attached thereto which are detached from the can. Human nature being what it is many of these tabs are not properly disposed of but become litter. This has resulted in this type of can end structure being made illegal in many states.

The ring top/detachable portion can end structure has been supplanted in many cases by the so-called "retained tab" end structure in which a tab permanently riveted to the can end pivots upon a consumer's desiring to open the can and a portion of the tab comes into contact with a portion of the end of the can outlined by a partly circular score line defining an opening. When the consumer pulls one end of the tab further away from the can end, it pivots about a hinging line, and its other end pushes harder on the score-defined portion of the can used. Eventually the portion of the can end outlined by the score line pivots about the unscored portion of the circular line and is pushed inwardly into the can, thus opening it and permitting the consumer to have access to the contents of the can. In this way the can can be opened without use of tools, while neither tab nor the opening portion of the end become detached from the can itself.

However, it will be appreciated that it is not satisfactory to place concealed promotional information on the underside of the portion of the can end which is rotated into the can upon opening as this is invisible to the user. Moreover, it is not convenient to print advertising or other promotional material on the under side of the tab due to the nature of the sequence of manufacturing operations commonly used to manufacture such tabs. Nor would it be possible to scribe or indent promotional material into the tab, as even if it were scribed onto the underside of the tab it would tend to print through to the upper side thus allowing the consumer to see what the promotional material was prior to opening the can, which would be undesirable particularly in the case of contests having monetary or other valuable prizes.

Accordingly, there is a need in the art for a can end of the type which can be opened without tools and without detachment of any portion of the can end from the can proper, while permitting provision of concealed promotional material thereon.

OBJECT OF THE INVENTION

It is accordingly an object of the invention to provide a can end of the retained-tab type with provision of promotional material thereon.

It is a further object of the invention to provide a retained-tab type can end adapted for imprintation of concealed promotional material thereon.

It is a further object of the invention to provide a can end having provision for concealed promotional material thereon which is readily manufacturable and no more expensive than prior art can ends.

SUMMARY OF THE INVENTION

The above needs of the art and objects of the invention are satisfied by the present invention according to which a can end of the retained tab variety has promotional material printed on the surface of the can end under the tab around the rivet holding the tab to the can. In this way, it is impossible to view the promotional material without opening the can. Rotation of the tab does not expose the promotional material to view.

BRIEF DESCRIPTION OF THE DRAWINGS

The invention will be better understood if reference is made to the accompanying drawings, in which.

DESCRIPTION OF THE PREFERRED EMBODIMENTS

Figure 1:
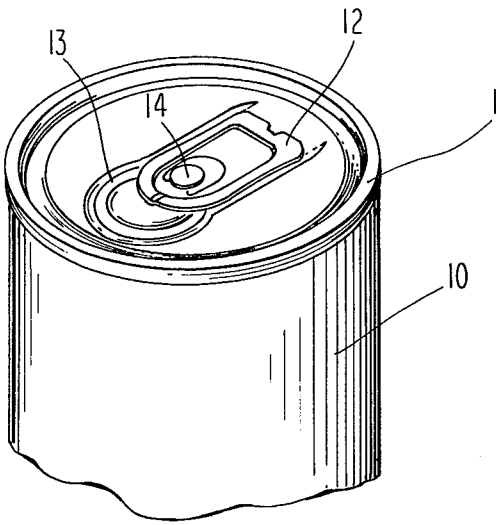
FIG. 1 shows a perspective view of a can fitted with a can end according to the invention.

FIG. 1 shows a perspective view of a can end 11 according to the invention affixed thereto by any conventional means. The can end 11 comprises a tab 12 attached to the can end 11 by a rivet 14 which is preferably formed integrally with the end of the can 11. As discussed in commonly assigned U.S. Pat. No. 4,184,607, the tab 12 is desirably formed of steel coated with zinc, and the end 11 is aluminum. Also formed in the end of the can 11 is an openable portion 13, defined by a score line which forms an almost complete circle, and partially overlayed by one end of the tab 12 such that upon pivoting of the tab 12 about a hinged line formed by its shape by a user desiring access to the can, the end of the tab 12 over the scored circular portion of the can end 10 is pushed into the scored portion, tending to separate it along the score line and causing the score-defined portion 13 to pivot into the interior of the can 10, thereupon revealing promotional material printed underneath the tab 12 on the end of the can 11, preferably on the unscored portion of the can end 11 as well as partially on the scored portion. In either case it is not possible to see the promotional material without opening the can as the tab 12 is closely juxtaposed to the can end 11 prior to opening by a user.

Figure 2:
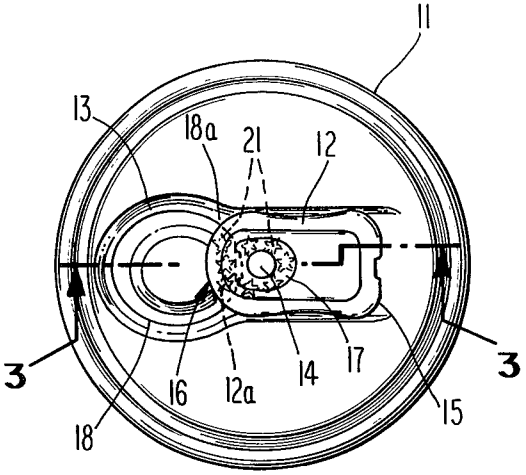
FIG. 2 shows an end view of the can and details of the can end.

Reference is now made to FIG. 2 for a more detailed description of the operation of the can end according to the invention. The can end 11 again is shown having a tab 12 attached thereto by an integrally formed rivet 14. The tab comprises a movable portion 15 and a substantially fixed portion 17 which is that held down by the rivet 14. A dotted line 12*a* describes the demarcation between the fixed and movable portions of the tab, along which the tab 12 pivots when its end 15 is picked up by a consumer desiring access to the can. The opposing end of the tab 16 is then caused to pivot downwardly, contacting the openable portion 13 of the can end which is defined by score line 18 extending generally circularly to define the openable portion 13 except for an unscored portion 18*a* about which the portion 13 pivots into the can, and which prevents disconnection of the openable portion 13 from the can end 11. The tab 12 is retained by rivet 14 after opening of the can. As noted, disposed underneath the tab on the surface of the can end, including the moving portion 13, is promotional material concealed until the can is opened, in this case shown as stars 21. It would be appreciated that any sort of promotional material is possible, e.g., numbers, stars, letters forming a word or the like, in accordance with any desired promotional scheme. What is important according to the principles of the present invention is that the promotional material 21 be entirely concealed by the tab 12 until the tab is pivoted upwardly thus opening the can, and obliging the consumer to purchase the can and its contents.

Figure 3:
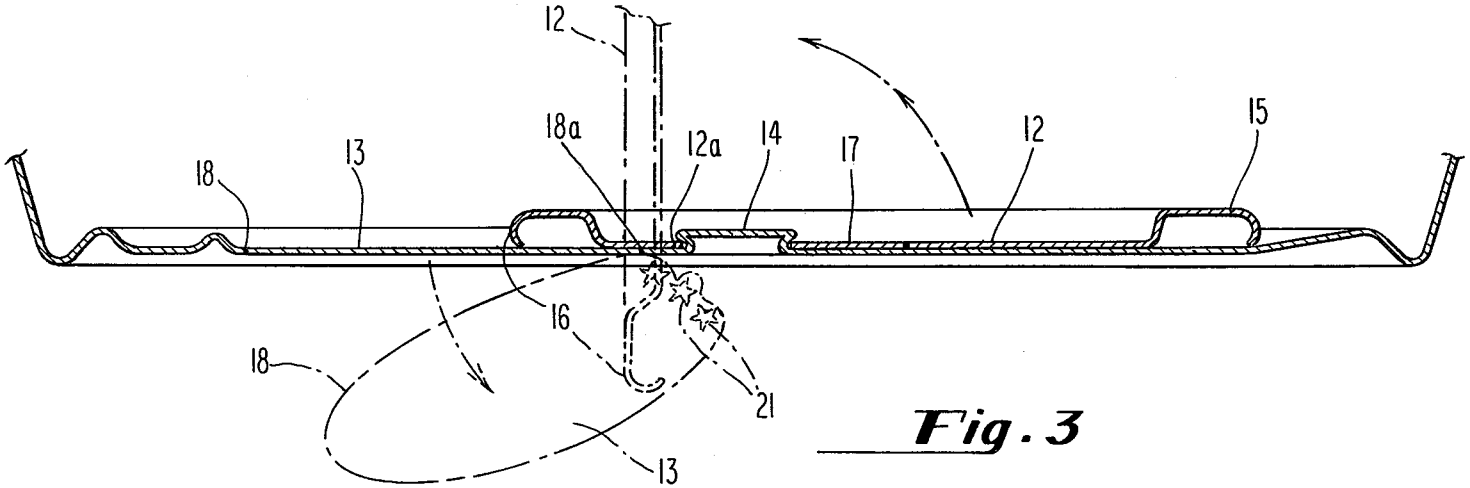
FIG. 3 is a cross-section taken along the line 3—3 of FIG. 2 showing how the promotional material is exposed upon opening of the can but at no other time.

FIG. 3 shows a cross-sectional view taken along line 3—3 of FIG. 2 and shows further details of the construction of the can end according to the invention. FIG. 3 shows the integral construction of the rivet 14 which holds the tab 12 to the body of the can end 11. It is further shown how an end 16 of the tab 12 is juxtaposed to the openable portion 13, defined by the score line 18, of the can end 11. Thus upon picking up of a first end 15 of the tab 12 by a consumer, the tab pivots around a hinged portion 12*a*, formed where the stationary portion 17 of the tab 12 is joined to the moving portion 15 of the tab 12, forcing the can end portion 13 to be detached along the score line 18 and to pivot about unscored portion 18*a* inwardly into the interior of the can 10. Upon bending back of the tab 12 substantially to its original position, the promotional material 21 printed on the moveable portion 13 of the can end 11 is exposed. Additionally it is frequency the case that the tab does not assume its close juxtaposition to the can end 11 and that additional promotional printed material on the nonmoving portion of the can end 11 is thus visible after opening the can.

It will be appreciated that there has been described a method for placing promotional material on a can end which satisfies the needs of the art and objects of the invention mentioned above. The promotional material is entirely concealed until the can end is opened yet thereafter is readily viewed without requiring detachment of any portion of the can end from the can. Since the tab is substantially symmetric about the axis of the rivet it can be rotated without exposing the promotional material, thus frustrating the attempts of the those who would try to learn what promotional material is on a given can end without purchase of the can. In the case of a promotional game, in which consumers are urged to complete a set of can ends to win a prize or the like, the can end itself thus becomes a game piece. Finally the invention may be implemented simply by printing promotional material on can end formed according to prior techniques, in particular as discussed in commonly assigned U.S. Pat. No. 4,184,607, incorporated herein by reference, without substantial complication of the processes there disclosed.

Finally it will be appreciated that the above description of the invention is that of a preferred embodiment and that therefore the above description should not be considered a limitation on the invention but merely as exemplary thereof. The invention is to be limited only by the scope of the following claims:

We claim:

1. In a can end of the type comprising a fixed portion and an openable portion defined by a score line and adapted to be pivotable about a hinge portion by pressure exerted by a tab member pivotable about a hinged section, the improvement which comprises promotional printed matter printed on said end and concealed under said tab until said tab is pivoted so as to open said can.

2. The can end of claim 1, wherein said promotional material is printed at least in part on that portion of the can end which is not moved by motion of said tab.

3. The can end of claim 1, wherein said movable portion of said can end and said tab remain attached to said can end after opening thereof.

4. A can end assembly comprising an end portion and a tab, said tab being affixed to said end portion by means permitting said tab to pivot to exert a force on an openable section of said end portion, promotional material being printed on said end portion under said tab, such that said tab conceals said promotional material until said tab is pivoted to open said openable section of said end portion.

5. The can end assembly of claim 4, wherein said end portion is aluminum and said tab is steel.

6. As a game piece for the playing of a game in which a plurality of like pieces each having indicia printed thereon are collected as an object of the game, the indicia being concealed by the game piece until goods to which the game pieces is attached are purchased, a can end assembly comprising an end portion and a tab, said tab being affixed to said end portion by means permitting said tab to pivot to exert a force on an openable section of said end portion, indicia being printed on said end portion under said tab, such that said tab conceals said indicia until said tab is pivoted to open said openable section of said end portion.

* * * * *